United States Patent [19]

Basiulis

[11] 4,057,963

[45] Nov. 15, 1977

[54] HEAT PIPE CAPABLE OF OPERATING AGAINST GRAVITY AND STRUCTURES UTILIZING SAME

[75] Inventor: Algerd Basiulis, Redondo Beach, Calif.

[73] Assignee: Hughes Aircraft Company, Culver City, Calif.

[21] Appl. No.: 665,757

[22] Filed: Mar. 11, 1976

[51] Int. Cl.[2] ..... F28D 15/00

[52] U.S. Cl. ..... 60/641; 126/271; 165/105; 237/67

[58] Field of Search ..... 165/105, 106; 237/59, 237/60, 61, 64, 67; 60/641; 126/271

[56] References Cited

U.S. PATENT DOCUMENTS

| | | | |
|---|---|---|---|
| 2,068,549 | 1/1937 | Knight | 165/105 X |
| 2,707,593 | 5/1955 | Woodcock | 237/60 |
| 3,913,665 | 10/1975 | Franklin et al. | 165/105 |
| 3,951,204 | 4/1976 | Movick | 165/1 |

*Primary Examiner*—Albert W. Daws, Jr.
*Attorney, Agent, or Firm*—Lewis B. Sternfels; W. H. MacAllister

[57] ABSTRACT

A heat pipe has its evaporator at its upper end and its condenser at its lower end and an adiabatic section separating the two so that capillary wicks or grooves do not extend through the heat pipe. A central liquid return tube extends between the evaporator and condenser. A vapor bubble generator is placed at the condenser section in the reservoir where the liquid state of the working fluid collects. When the vapor bubble generator is operated, bubbles form which, because of their buoyancy, will rise to the top of the central tube. As they rise, small amounts of working fluid in its liquid state will be carried with the bubbles and spill over the top of the tube and onto the evaporator wick. As a consequence, the heat pipe is insensitive to its vertical height and can operate against gravitational forces.

9 Claims, 4 Drawing Figures

Fig. 1.
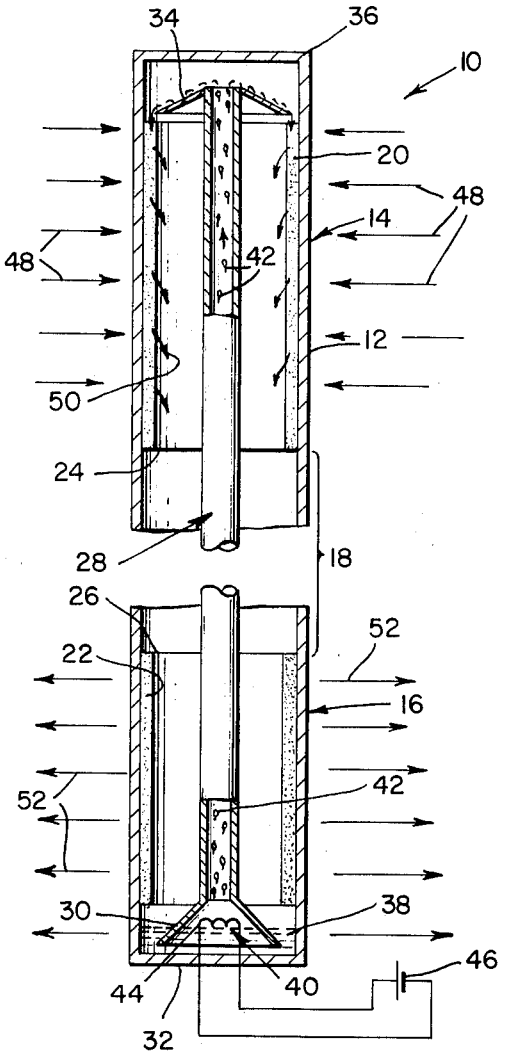
Fig. 2.
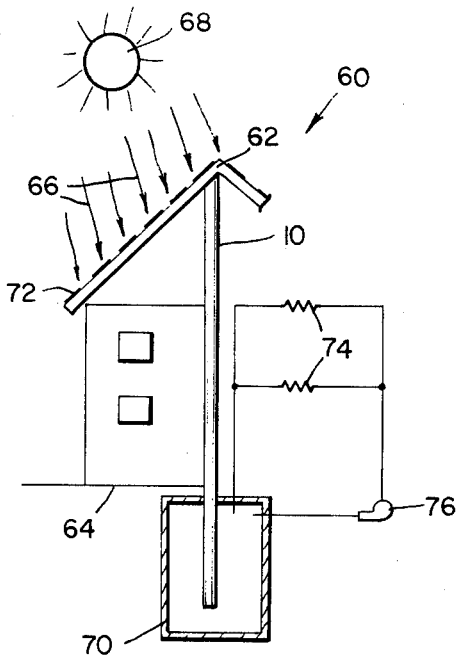
Fig. 4.
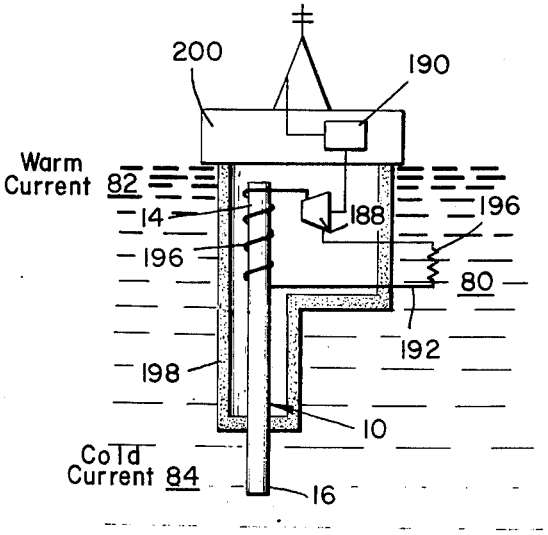
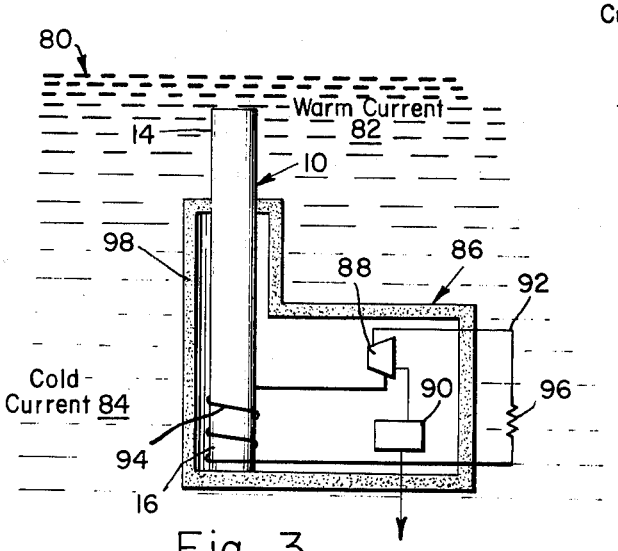
Fig. 3.

HEAT PIPE CAPABLE OF OPERATING AGAINST GRAVITY AND STRUCTURES UTILIZING SAME

BACKGROUND OF THE INVENTION

1. Field of the Invention

The present invention relates to heat pipes and structures usable therewith which are capable of operating against gravity.

2. Description of the Prior Art

Conventional heat pipes with homogeneous wicks have limited operating capability. Their capability to operate against gravity depends largely on the properties of the working fluid. For example, a heat pipe with Dow-Therm A as the working fluid can operate about two inches in height against gravity, methanol will work up to seven inches, and water can operate up to twenty-four inches. Liquid metal pipes with lithium as the working fluid can operate six to ten feet against gravity; however, the operating temperatures are 1000° C and higher. Even with the best available working fluid, the capability of conventional heat pipes to operate against gravity is limited. Thus, for applications where heat pipes are required to operate ten to forty feet against gravity, there are no single heat pipe systems presently available.

It is possible, of course, to cascade a plurality of heat pipes to overcome the above gravity problems. For example, water heat pipes of two feet in length can be stacked in series to form a forty foot long assembly. One very serious drawback to such a system is that, as the number of stages increase, the overall differential temperature of the system increase. For example, a forty foot long heat pipe, having twenty stages, will gain 2° F per stage for a total of 40° F. Special design can be developed to reduce the overall differential temperature by a judicious design.

SUMMARY OF THE INVENTION

The present invention borrows the principle used by airlift pumps or coffee percolators to return fluid from the condenser to the evaporator through a central tube by use of vapor bubble pumping. A high intensity heater at the bottom of the heat pipe and in the condensed working fluid generates vapor bubbles. The buoyant force of the bubbles causes them to rise to the top of the tube. As bubbles rise, small amounts of working fluid flow with the bubbles and spill over the top into the wick of the evaporator.

It is, therefore, an object of the invention to provide for a heat pipe whose operation is independent of gravity.

Another object of the present invention is to provide for such heat pipes of large length which are substantially vertically positioned, in particular, with the evaporator section above the condenser section.

Another object of the present invention is the use of such heat pipes in habitable structures for temperature control and for heating, for example, of water.

Another object is to provide for the use of ocean currents of different temperatures in conjunction with such heat pipes for purposes, for example, of generating electricity.

Other aims and objects and well as a more complete understanding of the present invention will appear from the following explanation of exemplary embodiments and the accompanying drawings thereof.

A BRIEF DESCRIPTION OF THE DRAWINGS

FIG. 1 depicts the basic concept of the present invention;

FIG. 2 illustrates a typical application of the heat pipe shown in FIG. 1 for solar heating of buildings, in which heat absorbed on the roof is pumped to the basement for use in thermostatic heating of the dwelling or in producing hot water; and FIGS. 3 and 4 illustrate the use of the heat pipe depicted in FIG. 1 for harnessing ocean thermal-gradients for power generation.

DESCRIPTION OF THE PREFERRED EMBODIMENT

Referring now to FIG. 1, a heat pipe 10 has an enclosure 12 formed of suitable material and comprises an evaporator section 14, a condenser section 16, and an adiabatic section 18. Within evaporator and condenser sections 14 and 16 are independent capillary wicks or grooves 20 and 22 of any suitable material or configuration in order to provide the proper or necessary capillary attraction within heat pipe 10. For proper operation of the present invention, it is necessary that wicks 20 and 22 be separate; therefore, wick 20 ends at 24 and wick 22 ends at 26, thereby forming adiabatic section 18.

A liquid return tube 28 extends substantially throughout the length of enclosure 12 and is provided with a conical end baffle 30 at one end 32 of enclosure 12 and a second conical end baffle 34 at upper end 36 of enclosure 12. Both baffles 30 and 34 are secured to return tube 28 in any convenient manner and extend therefrom towards bottom end 32.

As shown, working fluid is intended to vaporize in evaporator section 14 and condense in condenser section 16 to collect as a liquid 38 within a reservoir formed by bottom end 32.

A vapor bubble generator, generally identified by indicium 40, is placed within baffle 30 and may comprise any means by which the working fluid in its liquid state 38 may be caused to boil to form bubbles 42 which carry liquid working fluid up through conduit 28 and over baffle 34 for deposition onto wick 20 in evaporator section 14. Vapor bubble generator 40 may comprise any suitable means and is herein shown as a heater element 44 electrically coupled to a source of power 46. Preferably, vapor bubble generator 40 comprises a low power, high temperature heater.

Upon heating of element 44, bubbles 42 form and, because of the their buoyancy, will rise to the top of the tube. As these bubbles rise, small amounts of the working fluid will be carried with the bubbles and will spill over and flow over the baffle 34 onto evaporator wick 20. In the relationship $F = vg(\rho_l - \rho_v)$, where F is the buoyant force (e.g. in dynes), $v$ is the vapor bubble volume (e.g. in $cm^3$), $g$ is gravity (e.g. $cm/sec^2$), $\rho_l$ and $\rho_v$ respectively are the density of the liquid and density of the vapor (e.g., in $gm/cm^3$), since the buoyant force F and the liquid density $\rho_l$ will increase proportionally to the column height of heat pipe 10, the longer that the heat pipe becomes, the larger will be the buoyant force. Although the liquid pumping rate depends on heater power, only a small amount of heat is required to provide liquid pumping. Once evaporator wick 20 is saturated, the heat pipe will operate. When heat is added at the evaporator section as illustrated by arrows 48, the working fluid as a vapor will flow down, as indicated by arrows 50, to condenser section 16 and will condense thereby giving up heat as shown by arrows 52. The condensate 38 collects in the reservoir at end 32 and will be pumped back up through return tube 28 to the evaporator wick 20.

One application of the present invention is depicted in FIG. 2 for solar heating of a habitable structure 60 having a roof 62 and a ground structure or basement at 64. Solar heating, such as depicted by arrows 66 from the sun 68, may be absorbed on the roof 62 by any convenient means. The heat is absorbed by heat pipe 10 at its evaporator section and is transmitted to an energy storage 70 from condenser section 16. The heat for the bubble generator, such as generator 40, may be provided by solar cells 72 positioned on or adjacent roof 62. Heat from storage 70 may be utilized for any purpose such as by heating of water for thermal control of structure 60 or for any other purpose, such use of the heat being depicted by resistances 74. Pumping may be affected by a pump 76.

Other applications for heat pipe 10 include utilization of ocean thermal gradients, for example, for power generation as shown in FIGS. 3 and 4. As shown, ocean or other large body of water 80 includes a warm current 82 and a cold current 84, the terms "warm" and "cold" being used only to indicate relative differences of temperature. In both FIGS. 3 and 4, heat pipe 10 has its evaporator section 14 vertically placed above its condenser section 16. The difference between the two systems depicted in FIGS. 3 and 4 is that, in the former figure, heat from the warm current 82 is utilized for transfer of the working fluid within heat pipe 10 while in the latter figure, cold current 84 is utilized as an ultimate heat sink for heat pipe 10.

In FIG. 3, a power generation system 86, for example, comprises a turbine 88 and an electric generator 90 coupled to turbine 88. A closed loop 92 passing through turbine 88 includes a closed loop evaporator 94 thermally coupled to heat pipe condenser 16 and a closed loop condenser 96 thermally coupled to cold current 84 of the ocean. A thermal insulation enclosure 98 encloses the entire system with the exception of heat pipe evaporator section 14 and closed loop condenser 96. In operation, heat from warm current 82 heats working fluid in evaporator section 14 which flows as a vapor to heat pipe condenser section 16. The heat therefrom is used to heat the fluid within cooling system 92 in closed loop 94 which thereafter flows through turbine 88 for operation thereof and for condensation in closed loop condenser 96 for return to closed loop evaporator 94.

In FIG. 4, a closed loop 192 extends through a turbine 188 and includes a condenser 196 in thermal contact with heat pipe evaporator section 14 and a closed loop evaporator 196 positioned in warm current 82. A thermal housing 198 extends about the entire structure with the exception of heat pipe condenser section 16, which is in thermal contact with cold current 84. In this embodiment, heat from warm current 82 is transmitted through closed loop evaporator 196 which passes through and operates turbine 188 and which gives up its heat at closed loop 196 to heat pipe evaporator 14. The working fluid within the heat pipe then moves as a vapor to heat pipe condenser section 16 which is converted from its vapor state to its liquid state by virtue of the ocean cold current 84. Turbine 188 drives generator 190 for production of energy which is transmitted from, for example, a floating platform 200.

Although the invention has been described with reference to particular embodiments thereof, it should be realized that various changes and modifications may be made therein without departing from the spirit and scope of the invention.

What is claimed is:

1. A heat pipe capable of operating against gravity comprising:

means for defining a heat pipe envelope;

means for defining a working fluid in said envelope means;

means for defining evaporator and condenser sections in said envelope means with means therein for exerting capillary attraction on said working fluid means in its liquid state, said evaporator means being gravitationally higher than said condenser means;

means in said envelope means for maintaining a physical separation between said capillary attraction means of said evaporator and condenser section means;

means for defining a conduit coupled between said evaporator and condenser section means for said working fluid means in its liquid state; and means producing bubbles for transporting said working fluid means in its liquid state through said conduit means from said condensing section means to said evaporator section means.

2. A heat pipe as in claim 1 wherein said conduit means comprises a tube extending substantially centrally in said enclosure means.

3. A heat pipe as in claim 2 further including a reservoir at one end of said enclosure means for defining a terminus of said condenser section means and for collecting said working fluid means upon condensation thereof into its liquid state; and means on said conduit means extending into said reservoir for effecting at least a partial barrier between said bubble producing means and said capillary attraction means of said condenser section means.

4. A heat pipe as in claim 1 wherein said bubble producing means comprises a heater element coupled to a low power, high temperature electric power supply for enabling the bubbles to form at said heater element, to rise to the top of said conduit means, and to carry therewith small amounts of said working fluid means in its liquid state.

5. A heat pipe as in claim 4 wherein said partial barrier means comprises a first substantially conical baffle secured to said conduit means, and further including a second substantially conical baffle secured to said conduit means at the evaporator section end thereof opposite to said first substantially conical baffle, both said first and second baffles extending from said conduit means and towards said reservoir end of said enclosure means.

6. A heat pipe as in claim 1 further including a habitable structure, a solar collector on a surface of said habitable structure and adjacent said evaporator section means, and means for defining thermal storage at said condenser section means for heating purposes including supply of hot water and temperature control in said habitable structure.

7. A heat pipe as in claim 1 for using thermal gradients in warm and cold currents in a large body of water further including means for defining a turbine and an electric generator coupled thereto, and means including an evaporator and a condenser for defining a closed loop extending through said turbine for containing and transmitting a working fluid, one of said evaporator and condenser of said closed loop means being thermally coupled to said heat pipe enclosure means and the other of said evaporator and condenser of said closed loop means being thermally coupled to one of the warm and cold currents, and one of said heat pipe evaporator section and condenser section means being thermally coupled to the other of the warm and cold currents.

8. A heat pipe as in claim 7 wherein said large body of water comprises an ocean and said evaporator of said closed loop means is thermally coupled to said heat pipe condenser section means, said condenser of said closed loop means is thermally coupled to the cold ocean current, and said heat pipe evaporator section means is thermally coupled to the warm ocean current.

9. A heat pipe as in claim 7 wherein said large body of water comprises an ocean and said evaporator of said closed loop means is thermally coupled to the warm ocean current, said condenser of said closed loop means is thermally coupled to said heat pipe evaporator section means, and said heat pipe condenser section means is thermally coupled to the cold ocean current.

* * * * *